US005339329A

United States Patent [19]

Flinchum et al.

[11] Patent Number: 5,339,329

[45] Date of Patent: Aug. 16, 1994

[54] INDUCTION HEATED MENISCUS COATING VESSEL

[75] Inventors: Charles Flinchum, Hamilton, Ohio; Gerald L. Barney, Ashland, Ky.; Gregory S. Burgess, Proctorville, Ohio; Davis L. Kleinmeyer, Ashland, Ky.; Larry E. Parrella, Middletown, Ohio

[73] Assignee: Armco Steel Company, L.P., Middletown, Ohio

[21] Appl. No.: 8,105

[22] Filed: Jan. 25, 1993

[51] Int. Cl.[5] ..... H05B 6/22

[52] U.S. Cl. ..... 373/138; 373/155; 373/162; 118/410; 118/411; 118/429; 427/319; 427/320; 427/321; 427/431; 427/432; 427/436; 266/107; 266/129; 266/133; 266/166; 222/590; 222/591; 222/593

[58] Field of Search ..... 118/410, 411, 429; 266/103, 107, 129, 133, 166, 236; 222/590, 591, 593; 427/319, 320, 321, 431, 432, 436; 373/138, 155, 162

[56] References Cited

U.S. PATENT DOCUMENTS

| | | | |
|---|---|---|---|
| 2,914,419 | 11/1959 | Oganowski | 117/7 |
| 2,914,423 | 11/1959 | Knapp | 427/320 |
| 3,435,992 | 4/1969 | Tisdale et al. | 222/146 |
| 3,605,863 | 9/1971 | King | 164/156 |
| 3,809,570 | 5/1974 | Herman | 427/321 |
| 4,446,562 | 5/1984 | Friedman et al. | 373/149 |
| 4,475,721 | 10/1984 | Pamart | 266/236 |
| 4,557,952 | 12/1985 | Mitch et al. | 427/432 |
| 4,557,953 | 12/1985 | Boston et al. | 427/321 |
| 4,580,273 | 4/1986 | Crescenzi | 373/155 |
| 4,745,620 | 5/1988 | Mortimer | 373/152 |
| 4,973,500 | 11/1990 | Ishii et al. | 427/436 |
| 5,054,664 | 10/1991 | Bruckner | 222/590 |
| 5,197,081 | 3/1993 | Fishman | 373/138 |

FOREIGN PATENT DOCUMENTS

| | | | |
|---|---|---|---|
| 2219232 | 5/1989 | United Kingdom | B22D 41/04 |

*Primary Examiner*—Caleb Weston

*Attorney, Agent, or Firm*—R. J. Bunyard; R. H. Johnson; L. A. Fillnow

[57] ABSTRACT

A shallow vessel (50,52) for being horizontally disposed when containing a molten metal or metal alloy (66) for meniscus coating one side of a clean metal strip (34A) when the strip is moved vertically past one side of the vessel. The vessel includes a shell (68) such as austenitic stainless steel, a refractory lining (70), a molten metal departure lip (72) mounted on the upper surface of the side of the vessel, a spirally shaped induction coil (64) for maintaining the molten metal above its melting point and a flux concentrator (74). The induction coil is positioned below the refractory lining and the flux concentrator is positioned below the induction coil. The induction coil and the flux concentrator underlie the area occupied by the molten metal.

15 Claims, 4 Drawing Sheets

INDUCTION HEATED MENISCUS COATING VESSEL

BACKGROUND OF THE INVENTION

This invention relates to a shallow vessel for use on a coating line for meniscus coating one surface of a metal strip. More particularly, the invention relates to means for inductively heating molten coating metal contained in the vessel and means for concentrating the magnetic flux of the induction heater.

Conventional hot dip coating requires a metal strip to be immersed into a bath of molten metal. The immersion process generally requires a large vessel for containing molten metal having a depth of about two meters or more. It is well known to inductively heat molten metal while being contained within such large refractory lined vessels. It also is known to inductively heat such molten metal when being pumped or flowed through a refractory lined conduit. An induction coil may be disposed annularly with respect to the vessel or conduit either within the refractory lining or outside the vessel.

In recent years, techniques have been developed to coat one or both sides of metal strip with molten metals using a meniscus. U.S. Pat. No. 4,557,953 discloses horizontal meniscus coating one side of a steel strip. A cleaned strip is passed from a sealed snout to a large coating pot containing molten metal. Deflection rolls are used to pass the strip sufficiently close to the molten metal surface so that molten metal wets the lower surface of the strip and is withdrawn from the pot onto the surface of the strip.

U.S. patent application Ser. No. 07/803,278 filed Dec. 4, 1991; incorporated herein by reference, discloses vertical meniscus coating one or both sides of a steel strip using a horizontally disposed shallow vessel for containing molten metal. The vessel includes a departure lip mounted on the upper surface of one side of the vessel. The level of molten metal is maintained in the vessel relative to the upper elevation of the departure lip so that an uninterrupted flow of the molten metal can be delivered over the departure lip to a surface of the strip as the strip travels vertically past the departure lip. This patent application discloses that means for heating the departure lip may be provided to prevent freezing of the molten metal as it flows over the departure lip. The heating means may be in thermal contact with the departure lip or may be immersed into the molten metal bath.

Nevertheless, there remains a need for being able to heat molten metal contained within a relatively shallow vessel. There also remains a need for a heating means to maintain a uniform temperature of the molten metal contained within a shallow vessel.

BRIEF SUMMARY OF THE INVENTION

The invention relates to a shallow vessel for use on a coating line for meniscus coating one surface of a metal strip. The vessel is adapted to be horizontally disposed and includes a shell, a refractory lining on the inside surface of the shell, means for inductively heating the molten metal to a temperature above its melting point and means for concentrating the magnetic flux of the heating means. The concentrating means is positioned below the heating means. The heating and the concentrating means underlie the surface area occupied by the molten metal.

Another feature of the invention is for the aforesaid heating means being positioned below the refractory lining.

Another feature of the invention is for the aforesaid heating means being a spiral shaped induction coil.

Another feature of the invention is for the aforesaid concentrating means being a composite panel formed from an insulated iron powder.

An object of the invention includes providing means for efficiently inductively heating molten metal contained within a shallow vessel.

Another object of the invention includes providing means for inductively heating molten metal contained within a shallow vessel without heating the vessel.

Another object of the invention includes maintaining molten metal contained within a shallow vessel at a uniform temperature.

An advantage of the invention includes efficient thermal input to a molten metal bath contained in a shallow vessel. Other advantages include a heating means that is internally mounted within the vessel, maintaining a uniform bath temperature by gently stirring the molten metal, reducing costs for maintenance expense of the vessel and lowering operating costs by reducing the thermal input.

The above and other features, objects and advantages of the invention will become apparent upon consideration of the detailed description and appended drawings.

DETAILED DESCRIPTION OF THE PREFERRED EMBODIMENT

The invention relates to an inductively heated shallow vessel adapted to be horizontally disposed for vertically meniscus coating a molten metal onto one surface of a metal strip. The coating metals of the invention include but are not limited to commercially pure metals and metal alloys such as zinc, aluminum, lead, tin and copper. By shallow vessel will be understood to mean a vessel having a molten coating metal depth wherein the molten metal can receive the necessary power input from an induction heater to maintain a uniform bath temperature without violently stirring the bath. That is, stirring of the molten bath must not disrupt coating metal being withdrawn from the bath onto the metal strip surface. Molten metal having a working depth as shallow as about 20 mm is possible with an optimum depth being about 90 mm. The metal strip of the invention may include ferrous and non-ferrous metals such as low carbon steel, chromium alloyed steel and stainless steel in widths up to 200 cm or more.

Figure 1:
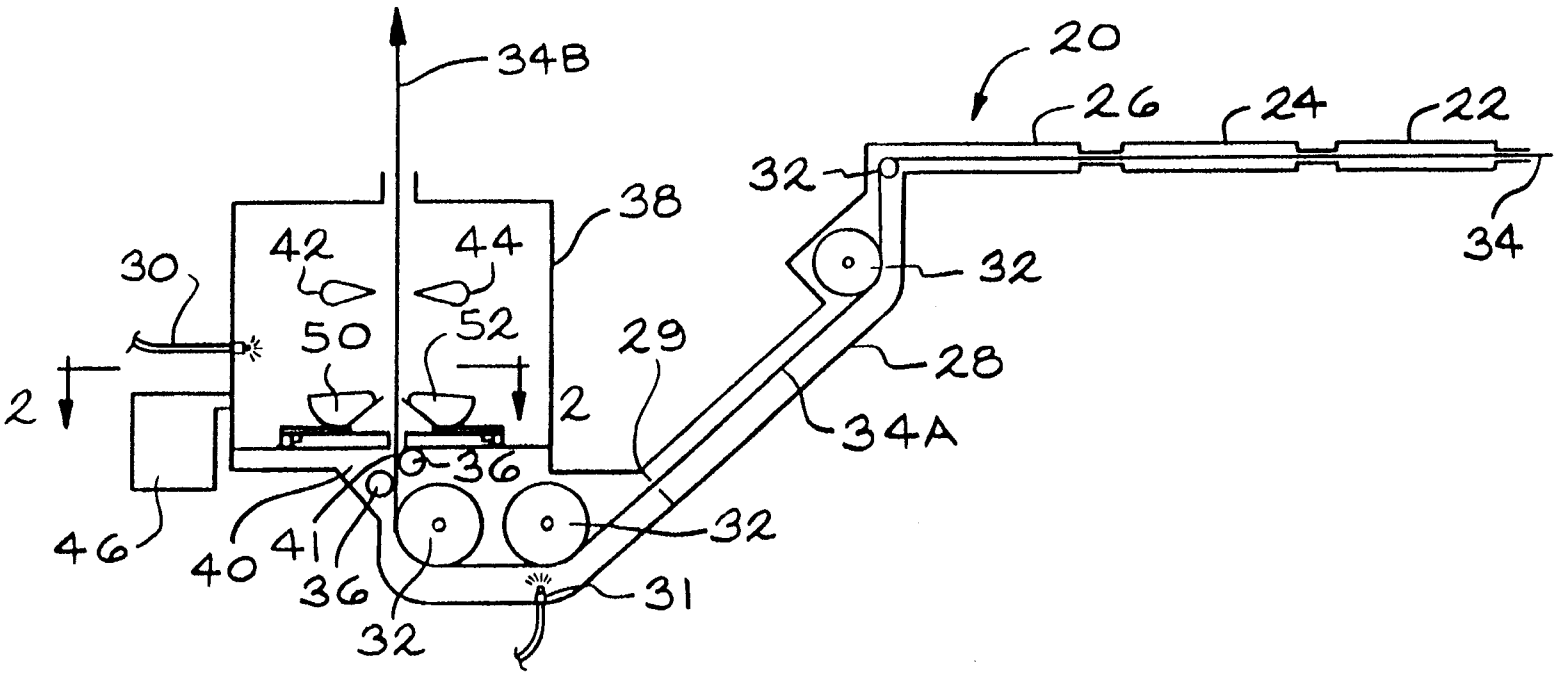
FIG. 1 is a diagrammatic elevation view of a coating line of the invention for continuously meniscus coating at least one side of a metal strip with molten metal including a pair of induction heated vessels for containing the molten metal.

FIG. 1 illustrates a high speed coating line 20 including means (not shown) for moving a metal strip 34, e.g., steel, through in-line strip preparation sections. Selas cleaning and heating equipment may be used to prepare strip 34 and include a direct fired preheat furnace section 22, a radiant heating furnace section 24, a cooling section 26 and a snout 28 for protecting a cleaned metal strip 34A being delivered to the meniscus coating apparatus. It will be understood the strip alternatively may be cleaned prior to being meniscus coated by applying a flux directly to the strip and then coating the flux coated strip with molten metal. The coating apparatus illustrated includes gas inlets 30 and 31, rollers 32 for changing the direction of travel of cleaned strip 34A, a pair of stabilizing rollers 36 positioned on opposite sides of strip 34A, a sealed coating chamber 38 for containing a protective atmosphere substantially non-oxidizing to a molten coating metal contained in a pair of horizontally disposed coating vessels 50 and 52 of the invention for being positioned on opposite sides of strip 34A and jet finishing nozzles 42 and 44 positioned on opposite sides of an as-coated strip 34B for controlling the thickness of the molten metal layer on each surface of strip 34B. A protective atmosphere non-oxidizing to cleaned metal strip 34A is used in furnace section 24, cooling section 26 and snout 28. Means for separating the atmosphere within snout 28 from the atmosphere immediately below coating vessels 50,52 such as slotted sealing plates 29 may be provided. When coating chromium alloyed steel, e.g., stainless steel, with molten aluminum, it is desirable to use commercially pure hydrogen as the protective gas in each of furnace section 24, cooling section 26 and snout 28. Sealing plates 29 may be used to prevent mixing of the hydrogen gas within snout 28 with the non-oxidizing gas, e.g., nitrogen, in sealed chamber 38. Sealing plates 29 prevent mixing of the protective gas within snout 28 and a protective atmosphere non-oxidizing to the cleaned metal strip, e.g., nitrogen, maintained within a sealed zone 40 below vessels 50,52. Even if sealed chamber 38 is not used, the pressure differential of the protective gas below vessels 50,52 and sealing plates 29 is sufficient to prevent passage of the ambient atmosphere above the coating vessels into sealed zone 40.

In operation, metal strip 34 normally will be heated in furnace sections 22,24 to a temperature at least near the melting point of the coating metal and up to as high as about 1000° C. Deep drawing grades of low carbon and chromium alloyed steels require heating to well above the melting point of the coating metal for good formability. The cleaned strip then may be cooled in cooling section 26 to near the melting point of the molten metal prior to being coated. A pressurized gas non-oxidizing to the molten coating metal, e.g., high purity nitrogen, may be directed from nozzles 42,44 to control the amount of molten metal remaining on strip 34B. When using non-oxidizing gas during galvanizing, water vapor preferably is injected into sealed chamber 38 through gas inlet 30 and possibly gas inlet 31 to prevent zinc vapor formation. When non-oxidizing gas is not required, sealed chamber 38 would not be necessary and may be removed.

Figure 2:
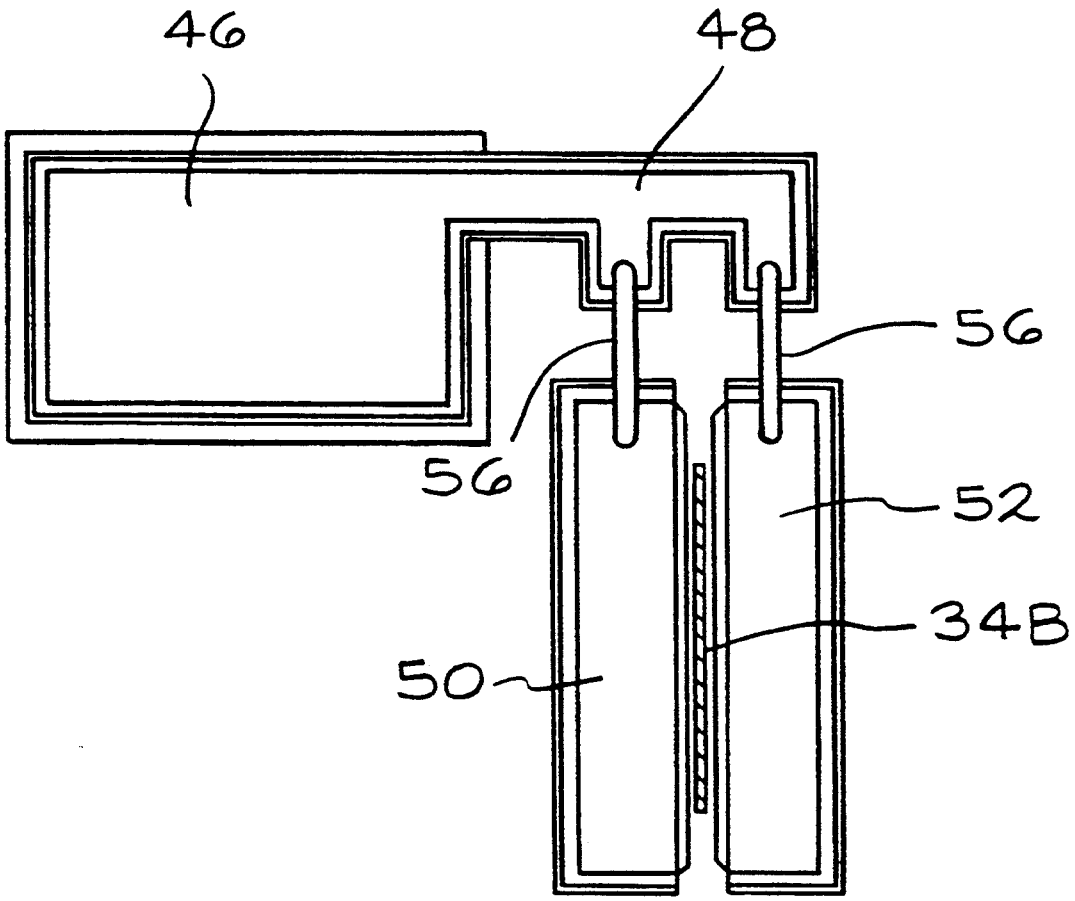
FIG. 2 is a plan view of means for delivering molten make-up metal to the vessels of the embodiment of FIG. 1.

FIG. 2 is a plan view along line 2—2 of FIG. 1 illustrating coating vessels 50,52 including a furnace 46 for melting make-up coating metal and means 48 for delivering the molten make-up metal to the coating vessels. In the embodiment in FIG. 2, delivery means 48 includes a siphon tube 56 for each vessel with the make-up metal being flowed by gravity to the coating vessels. Melting furnace 46 is positioned at the same elevation as coating vessels 50 and 52. The level of the molten metal in each of the vessels is maintained at the desired height by using a displacement plug in melt furnace 46. Coating vessels 50 and 52 are positioned on opposite sides adjacent to the surfaces of strip 34A for coating both surfaces with molten metal. When it is desired to coat only one surface of the strip with molten metal, the coating vessel not being used may be withdrawn from the strip surface. Make-up coating metal also may be pumped into the vessels or delivered as a solid directly into the molten bath in each coating vessel such as by feeding ingots, pellets or wire. Whether liquid or solid, make-up coating metal is delivered continuously or periodically to the coating vessels to maintain the level of molten metal in each of the vessels so that an uninterrupted flow of the molten metal is delivered to strip 34A.

Figure 3:
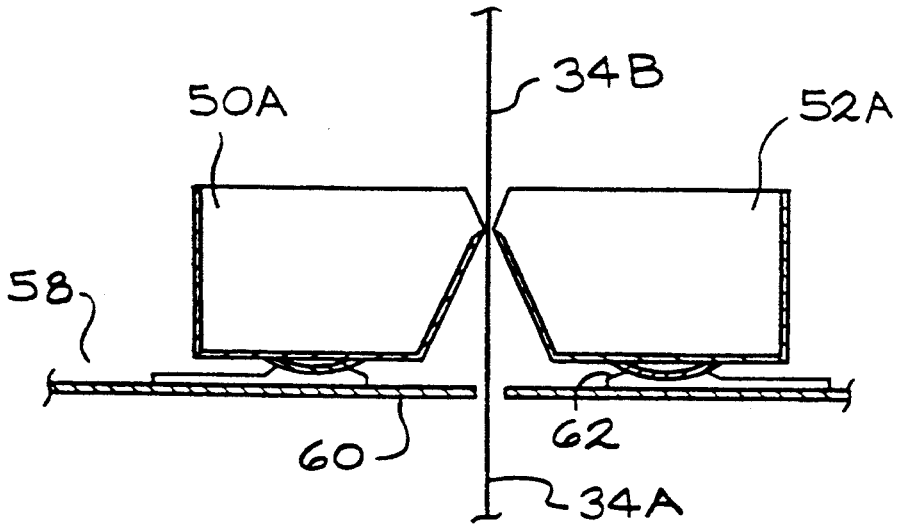
FIG. 3 is a diagrammatic view of another embodiment of the vessels of the invention for containing the molten coating metal.

FIG. 3 illustrates another embodiment of the vessels for containing the molten metal. The bottom portion of the vessels illustrated in FIG. 1 is an arcuate shape while the bottom portion of the vessels illustrated in FIG. 3 is planar. The particular configuration depends space availability. Means 58 may be provided for positioning one side of each coating vessel adjacent to and transversely with a planar surface of strip 34A to be coated with molten metal. Positioning means 58 may include a sled 60 having a cradle 62 mounted on the upper surface thereof for rotatably supporting the coating vessel. When it becomes necessary to position the coating vessel adjacent to the strip surface or to remove the coating vessel away from the strip, the sled is laterally displaced such as using a rack and pinion activation device. For example, it may be necessary to repair the coating vessel or to replace the molten metal in the coating vessel with a different type molten metal. It also may be necessary to reposition the coating vessel relative to the strip during and after line stops, when the strip is damaged or to remove one of a pair of coating vessels away from the strip when only one side of the strip is to be coated.

Figure 4:
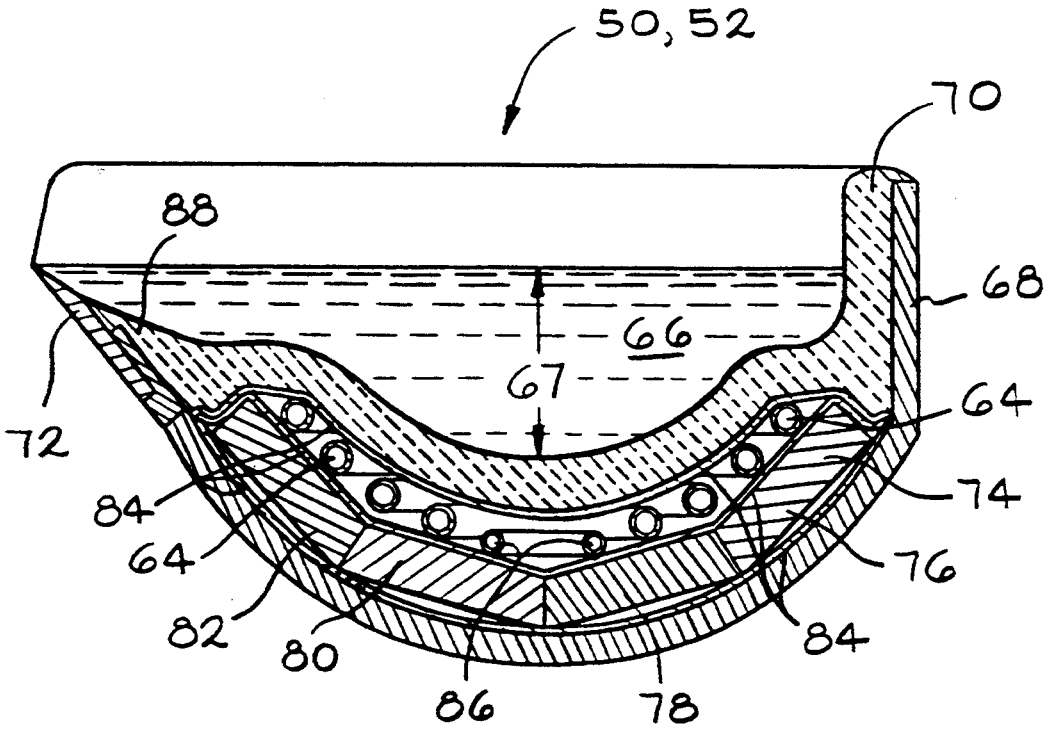
FIG. 4 is an enlarged elevation section view of one of the vessels of FIG. 1.

FIG. 4 illustrates details of one embodiment of a vessel of the invention for containing a body of molten metal. Each vessel 50,52 includes means for inductively heating a molten metal 66 having a working depth 67, an outer shell 68, an inner refractory lining 70, an upwardly inclined molten metal departure lip 72 mounted on an upper surface of one side of the vessel and means 74 for concentrating the magnetic influence of the induction heating means. The induction heating means is mounted within the vessel. Preferably, the heating means includes a coil 64 formed into a spiral shape and is positioned under refractory lining 70. The induction coil is operated by being connected to any suitable power source such as a DC generator. It is desirable to position the induction coil under the refractory lining to facilitate repair/replacement of the refractory lining as well as replacement of the coil. Induction coil 64 includes rectangularly shaped turns nested within insulation layers 84 such as glass fabric in the lower portion of the coating vessel at a position underlying most of the area occupied by molten metal 66. Induction coil 64 heats and maintains the body of molten metal at an elevated temperature sufficiently high to prevent freezing within the vessel or freezing on departure lip 72 during transfer from the vessel to metal strip 34B. It may be desirable to provide a cooling tube 86 to prevent excessive heating of the coil and the refractory lining. Concentrating means 74 is positioned below induction coil 64. For efficient heating of the coating metal, concentrating means 74 is necessary to concentrate the magnetic flux of coil 64 into coating metal bath 66. The concentrating means also advantageously minimizes the influence, i.e., heating, by the magnetic flux on shell 68. Flux concentrator 74 may be a layer of an insulated iron powder, available from Fluxtrol Manufacturing, Inc. of Troy, Mich. Preferably, the powder is encapsulated into an organic polymeric matrix and formed into composite panels. The composite panels may be positioned in a parallel spaced manner for forming the concentrator layer such as side-by-side panels 76, 78, 80, 82. In the embodiment illustrated in FIG. 4, the panels are nested between insulation layers 84. For a coating vessel such as illustrated in FIG. 4 having an arcuately shaped bottom, the panels preferably have a trapezoidal configuration as viewed in cross section. For a coating vessel having a planar bottom such as illustrated in FIG. 3, the panels may have a rectangular configuration as viewed in cross section. Alternatively, concentrating means 74 may be constructed from laminations of narrow width strips of grain oriented or non-oriented electrical steel. Depending upon the efficiency of concentrating means 74, it may be desirable that shell 68 is fabricated from a non-magnetic metal such as type 304 austenitic stainless steel.

Figure 5:
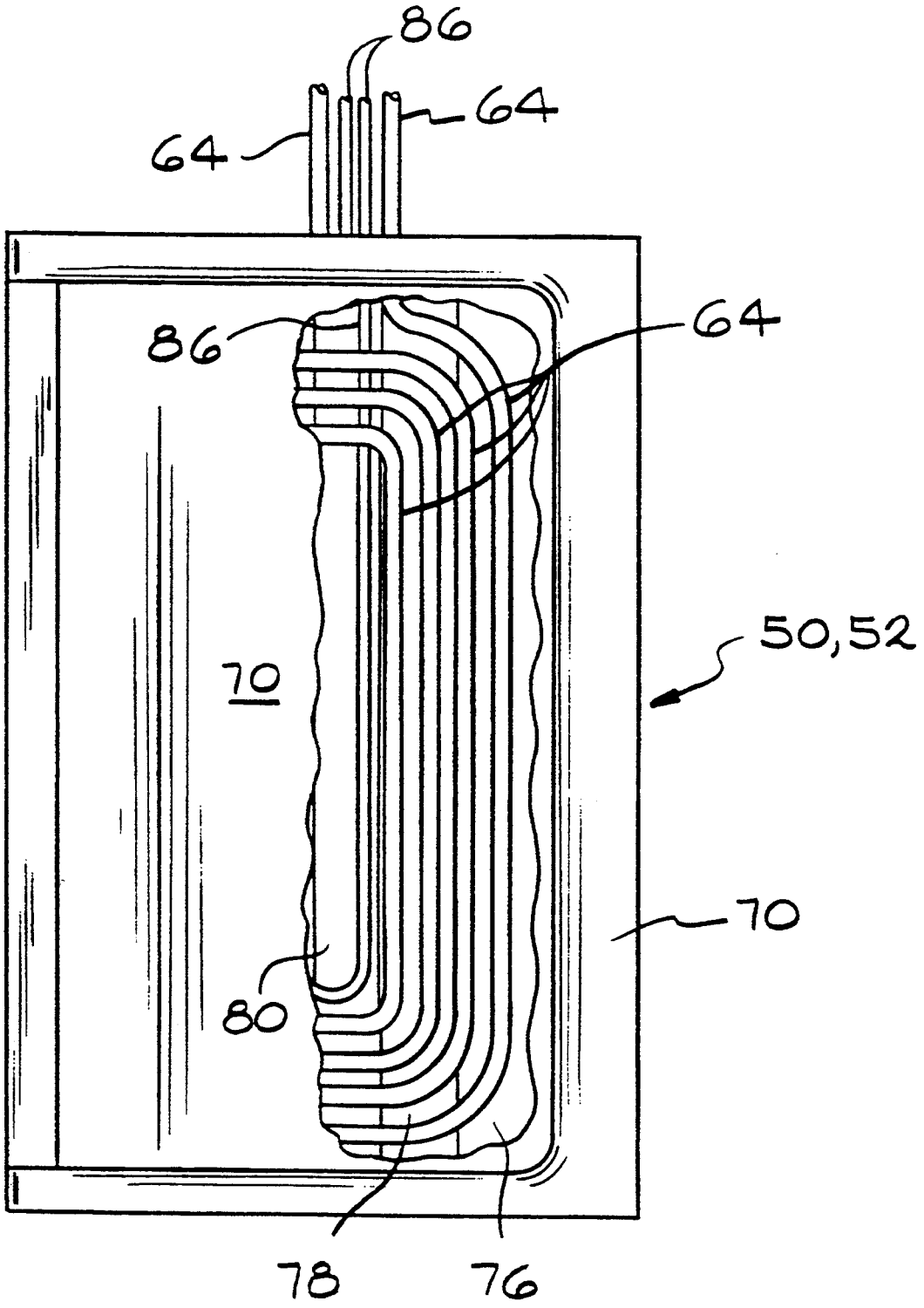
FIG. 5 is a plan view of FIG. 4 with portions removed.

FIG. 5 is a plan view, with portions removed, illustrating the positioning of induction coil 64 across the bottom of the vessel. Spiral coil 64 is generally rectangularly shaped so that it underlies substantially all of the area occupied by the body of molten metal contained in the coating vessel. Concentrating means 74 is positioned immediately below all the turns of the induction coil to maximize the coil heat input efficiency. Flux concentrator panels 76, 78, 80 and 82 extend the full width of the bottom of the vessel beyond the outermost turn of induction coil 64.

Another important feature of the invention is that induction coil 64 have a configuration so that substantially all the molten metal is heated. By underlying most of the vessel, coil 64 not only heats the entire molten metal bath but also creates a gentle rotation or stirring of the molten metal resulting in a uniform temperature throughout the bath. This gentle bath rotation circulates molten metal from the main bath area toward an unheated, increasingly shallower approach area 88 immediately ahead of departure lip 72. It is important that the molten metal have a uniform temperature as it crosses the departure lip. Uniform heating of the bath allows the molten metal being withdrawn from the bath by meniscus contact with the strip to properly react with the strip surface so that a coating layer of uniform thickness is formed across the entire width of the strip by the gas jet nozzle.

EXAMPLE 1

A static laboratory trial of an inductively heated shallow vessel of the invention similar to that illustrated in FIGS. 4 and 5 now will be described. The vessel was rectangularly shaped and included a straight steel departure lip mounted to the upper surface of one side thereof. The shell of the vessel was Type 304 stainless steel and its inside surface included a fiber containing ceramic lining of having a thickness of about 2 cm. The inner dimensions of the bath area of the vessel were about 22 cm wide, 20 cm long and 4 cm deep as measured from the upper elevation of the departure lip to the bottom of the molten metal bath. The induction coil was formed into a generally rectangular spiral shape having four turns spaced about 3 mm from one another. The coil was nested between the ceramic lining and the flux concentrator. Each of the flux concentrator panels was about 5 cm wide, 22 cm long and had a thickness of about 14 mm. Zinc was melted in a furnace to a temperature of 460° C. and then added to the horizontally disposed vessel until a working depth of about 25 mm of molten zinc coating metal was obtained. The induction coil was connected to a DC generator and operated using about 750 amps and 61 volts. Since it was desired to maintain the temperature of the molten zinc in the vessel at about 500° C., the power level of the induction coil was varied to observe the effect upon the vessel bath temperature. In this initial trial, molten zinc was not removed from the vessel. By varying the power settings of the generator between 3.75–6.97 kW, the zinc bath temperature was maintained within the range of 435°–510° C.

EXAMPLE 2

In another trial, a low carbon steel strip having a width of about 13 cm was meniscus coated on one surface with molten zinc by passing through a laboratory coating line similar to coating line 20 in FIG. 1 at a line speed of about 10 m/min. The strip was heated to a peak metal temperature of 838° C. using a nitrogen/hydrogen reducing atmosphere. The strip then was cooled to a temperature of about 465° C. in the snout immediately prior to being meniscus coated with molten zinc from the horizontally disposed vessel. Pressurized high purity nitrogen was passed through a jet nozzle to control the amount of molten metal remaining on the as-coated steel strip. The temperature of the molten zinc in the vessel at the start of the trial was about 500° C. By operating the induction coil as described in Example 1 using a power setting of 7.23 kW, the temperature of molten zinc having a working depth of about 25 mm in the vessel was maintained at about 500° C.

It will be understood various modifications can be made to the invention without departing from the spirit and scope of it. Therefore, the limits of the invention should be determined from the appended claims.

What is claimed is:

1. For use with apparatus for meniscus coating at least one surface of metal strip, comprising:

a shallow vessel for containing a body of molten metal, the vessel including a shell having and inside surface, a refractory lining the inside surface of the shell, means for inductively heating by magnetic flux the molten metal and means for concentrating the magnetic flux of the heating means, the concentrating means being positioned below the heating means which underlies the body of molten metal.

2. The vessel of claim 1 wherein the concentrating means is an insulated iron powder.

3. The vessel of claim 1 wherein the concentrating means is a plurality of composite panels.

4. The vessel of claim 3 wherein the panels are rectangularly shaped.

5. The vessel of claim 3 wherein the panels are trapezoidally shaped.

6. The vessel of claim 1 wherein the heating means is positioned below the refractory lining.

7. The vessel of claim 1 wherein the heating means is an induction coil.

8. The vessel of claim 7 wherein the induction coil has a spiral shape.

9. The vessel of claim 8 wherein the spiral shape is generally rectangular.

10. The vessel of claim 1 wherein the shell is austenitic stainless steel.

11. The vessel of claim 1 including a straight departure lip mounted on the upper surface of one side of the vessel.

12. The vessel of claim 1 being surrounded by a sealed chamber for containing a non-oxidizing atmosphere.

13. The vessel of claim 1 including an insulation fabric layer separating the refractory lining and the heating means.

14. The vessel of claim 1 including an insulation fabric layer separating the heating means and the concentrating means.

15. For use with apparatus for meniscus coating at least one surface of metal strip, comprising:

a shallow vessel for containing a body of molten metal, the vessel including a non-magnetic steel shell having an inside surface, a refractory lining the inside surface of the shell, a spirally shaped coil for inductively heating by magnetic flux the molten metal, means for concentrating the magnetic flux of the induction coil and a departure lip mounted on the upper surface of one side of the vessel, the induction coil being positioned below the refractory lining and the concentrating means being positioned below the induction coil, the induction coil and the concentrating means underlying the body of molten metal.

* * * * *